US011259669B2

(12) United States Patent
Popper

(10) Patent No.: US 11,259,669 B2
(45) Date of Patent: Mar. 1, 2022

(54) WASH AND SHOWER SYSTEM

(71) Applicant: Shay Popper, Kfar Yona (IL)

(72) Inventor: Shay Popper, Kfar Yona (IL)

( * ) Notice: Subject to any disclaimer, the term of this patent is extended or adjusted under 35 U.S.C. 154(b) by 38 days.

(21) Appl. No.: 16/977,010

(22) PCT Filed: Mar. 17, 2019

(86) PCT No.: PCT/IB2019/052150
§ 371 (c)(1),
(2) Date: Aug. 31, 2020

(87) PCT Pub. No.: WO2019/175851
PCT Pub. Date: Sep. 19, 2019

(65) Prior Publication Data

US 2021/0000303 A1 Jan. 7, 2021

Related U.S. Application Data

(60) Provisional application No. 62/644,205, filed on Mar. 16, 2018.

(51) Int. Cl.
*A47K 3/28* (2006.01)
*A61H 33/06* (2006.01)

(52) U.S. Cl.
CPC ..... *A47K 3/281* (2013.01); *A61H 33/063* (2013.01); *A61H 2033/061* (2013.01); *A61H 2201/0207* (2013.01); *A61H 2201/0264* (2013.01)

(58) Field of Classification Search
CPC ..... A47K 3/281
USPC ..... 4/524–525
See application file for complete search history.

(56) References Cited

U.S. PATENT DOCUMENTS

| | | | | |
|---|---|---|---|---|
| 4,348,777 | A | 9/1982 | Peterson | |
| 4,425,672 | A | 1/1984 | Johnson et al. | |
| 6,681,417 | B2 * | 1/2004 | Brunelle | A61H 33/06 4/524 |
| 7,168,108 | B2 | 1/2007 | Guerin et al. | |
| 7,454,803 | B2 * | 11/2008 | Guerin | A47K 3/28 4/524 |
| 9,161,882 | B2 * | 10/2015 | Faridoon | A47K 3/022 |
| 9,777,470 | B2 | 10/2017 | Mazz et al. | |
| 2005/0086735 | A1 | 4/2005 | Lim | |

(Continued)

FOREIGN PATENT DOCUMENTS

| | | | |
|---|---|---|---|
| CN | 2509986 | Y | 9/2002 |
| GB | 2020970 | A | 11/1979 |

OTHER PUBLICATIONS https://www.insigniaoutlet.co.uk/steam-showers.html.

*Primary Examiner* — Lori L Baker
(74) *Attorney, Agent, or Firm* — Mark David Torche; Patwrite Law

(57) ABSTRACT

A shower system for a shower having a water supply mechanism including a hot water supply and a cold water supply. The system includes: a shower stall; an air heating and delivery mechanism for heating and delivering hot air to the shower stall and including: an air inlet, air piping, an air supply blower to produce an air flow, an air heater, and a hot air outlet. The system further includes: a shower-water piping system including: a hot and cold water mixing valve; and a water fogger nozzle disposed within the hot air outlet to thereby produce a spray of hot air and water suspension; and an air and water temperature and flow controller.

9 Claims, 8 Drawing Sheets

(56) References Cited

U.S. PATENT DOCUMENTS

| | | | | |
|---|---|---|---|---|
| 2011/0186136 | A1 | 8/2011 | Hanna et al. | |
| 2013/0226109 | A1* | 8/2013 | Faridoon | A61H 35/00 604/290 |

* cited by examiner

WASH AND SHOWER SYSTEM

FIELD OF THE INVENTION

The invention relates to a wash and shower system, in particular a washing or showering system that uses humidified hot air, i.e. a suspension (miniaturized water droplets carried by a hot air stream), typically saturated.

BACKGROUND OF THE INVENTION

During a standard 10-minute shower, an average of 132 liters of water is used, most of which does not even touch the bather's body.

U.S. Pat. No. 7,168,108 discloses an aircraft shower stall having misting nozzles. The shower stall encloses a shower wall thereby defining an air channel. A controller directs misted air through the misting nozzles and activates an air flow system such that misted air within the shower area flows through and is dried in the air channel.

CN 2509986Y discloses a steam shower, including a roof, floor pan, mounted on glass panel doors and columns between the cap and the floor pan, and steam heaters, electrical controls, dispensing tap water, is inserted at least one hollow column between the hot air, nozzle, pipe, the cap and the floor pan, hot air is attached to the hollow cavity of the column, provided with a hot air fan heater and communication hollow pillar air inlet and outlet.

Other inventions with related to the technology background are disclosed in U.S. Pat. No. 9,777,470 (Kohler Co., 2017 Oct. 3) and in the web-site accessed by: https://www.insidniaoutlet.co.uk/steam-showers.html.

The above publications are incorporated herein by reference, in their entirety.

SUMMARY

The present invention relates to a wash and shower system that provides a water-humidified, typically saturated, hot (heated) air stream (i.e. the air stream or spray is heated and miniaturized water droplets are suspended therein). The system is implementable, mutatis mutandis, as a faucet system for washing one's hands; a bidet system; a shower system and so on. Thus, even though the invention will be described with respect to a shower, it should be understood that similar washing applications are possible; and herein the specification and claims, the term "shower" and "showering" and their derivations will be deemed to include "wash" and washing" and the like.

It is emphasized that the hot-air/water suspension is not a steam spray or mist, which is water vapor and not a hot air-water suspension as in the present shower system. It is further noted that the water-saturated hot air is produced by mixing the water droplets into a pre-heated air stream. This situation increases the quantity of water that can be incorporated in the resultant hot-air/water suspension to help maintain good cleaning results while still reducing the amount of water required.

Whereas traditionally a shower is performed using water only, in accordance with the present invention, a shower system is provided whereby one can shower using a heated airflow with a controllable flow of miniaturized water droplets, and which can control the air-to-water ratio in the resultant suspension; however the heated air is typically saturated or close to saturated. The system provides a warm/hot air flow humidified with miniaturized water droplets to produce a suspension, at a controlled temperature and flow rate.

At the end of the shower, the user can choose a warm air stream providable by the wash/shower system, without added water spray, so that after a few pleasant minutes the user can leave the shower without dripping water and potentially even without the need for a towel.

In accordance with embodiments of the present invention there is provided a wash or shower system having a water supply mechanism including a hot water supply and a cold water supply. The shower system includes: a shower stall; and an air heating and delivery mechanism for heating and delivering hot air to the shower stall. The air heating and delivery mechanism includes: at least one air inlet; air piping; an air supply blower to produce an air flow; at least one air heater; and at least one hot air outlet. The shower system further includes a shower-water piping system for delivering hot and cold water to the shower stall, which includes: a hot and cold water mixing valve; and at least one water fogger nozzle respectively disposed within the at least one hot air outlet to thereby produce a spray of hot air and water suspension. The shower system also includes an air and water temperature and flow controller.

In some embodiments, the at least one air heater includes an electric heater. In some embodiments, the at least one air heater includes a heat exchanger configured so that the air is heated by hot water from the hot water supply. In some embodiments, the at least one water fogger nozzle is respectively disposed adjacent the outlet of the at least one hot air outlet. In some embodiments, the system further includes a water supply pump configured to increase the pressure of the water. In some embodiments, the system of further includes an air inlet filter. In some embodiments, the air and water temperature and flow controller is configured to be controllable via a controller panel of the shower system. In some embodiments, the air and water temperature and flow controller is configured to be controllable via a smartphone application. In some embodiments, the air and water temperature and flow controller is configured to control the ratio of hot air to hot water in the spray.

In some embodiments, the shower system includes a blower for supplying air flow; an air heating radiator configured to use the heat of the shower's hot water; an electric air heater, a water heater; a control panel; a temperature control mechanism; and a water flow mechanism, which is configured to produce an air-water suspension in the form of tiny water droplets suspended in and saturating the air flow to produce a mixed air-water spray. The air-water suspension can be directed to a main shower head outlet, as well as to optional secondary outlets, surrounding the bather.

The shower system can use power from commonly existing sources in the home, such as electricity or natural gas power. Alternatively, the shower system can include a power supply and a backup battery. The shower system can also include any of: shower lights, audio speakers and a microphone. The system may further include a control unit, which may be connected to a smart-home system; a water heater and/or a solar hot-water system; and water pressure boost pumps.

The system may include a low-flow water outlet that allows for limited warm water use, such as for hair or intimate washing. The control panel allows control over the water-saturated air flow rate and mix. The main shower head outlet and spray nozzles can be manually directed and closed, or controlled via the control panel; and the same goes for the water-air temperature, the flow rate and the water suspension density (the ratio of air to water) at the various nozzles. The control panel may also control the shower lighting and display the amount of water used and the amount of water saved.

It is a particular feature of the present invention to provide a wash and shower system that is configured to mix heated air with miniaturized water droplets to produce a suspension, to thereby reduce the use of wash and shower water, while still providing a significant quantity of water to the user for cleaning purposes.

It has been found that bringing the afore-mentioned heated air and miniaturized water droplets, exiting the water spray fogger nozzle(s), into contact with each other at, or very close to, the respective spray outlets produces a particularly effective suspension stream in that the miniaturized water droplets and heated air mixture produce a suspension spray that carries well (i.e. produces a reasonably directed spray to the user rather than simply distributing into a wide cloud); and produces an air-water suspension that saves a considerable quantity of water while still producing a spray that provides for efficient washing.

BRIEF DESCRIPTION OF THE FIGURES

Exemplary embodiments are illustrated in the figures. Dimensions of components and features shown in the figures are generally chosen for convenience and clarity of presentation and are not necessarily shown to scale. The figures are listed below.

DETAILED DESCRIPTION OF EMBODIMENTS

The present invention relates to a wash/shower system designed to provide a hot-air/water suspension. The basic principle of the system is a heated air stream saturated with miniaturized water droplets. The system is a comprehensive wash/shower solution that uses a heated air stream saturated (or significantly saturated) with water. In order to enable pleasant washing/showering, both the air and the water are heated.

Figure 1:
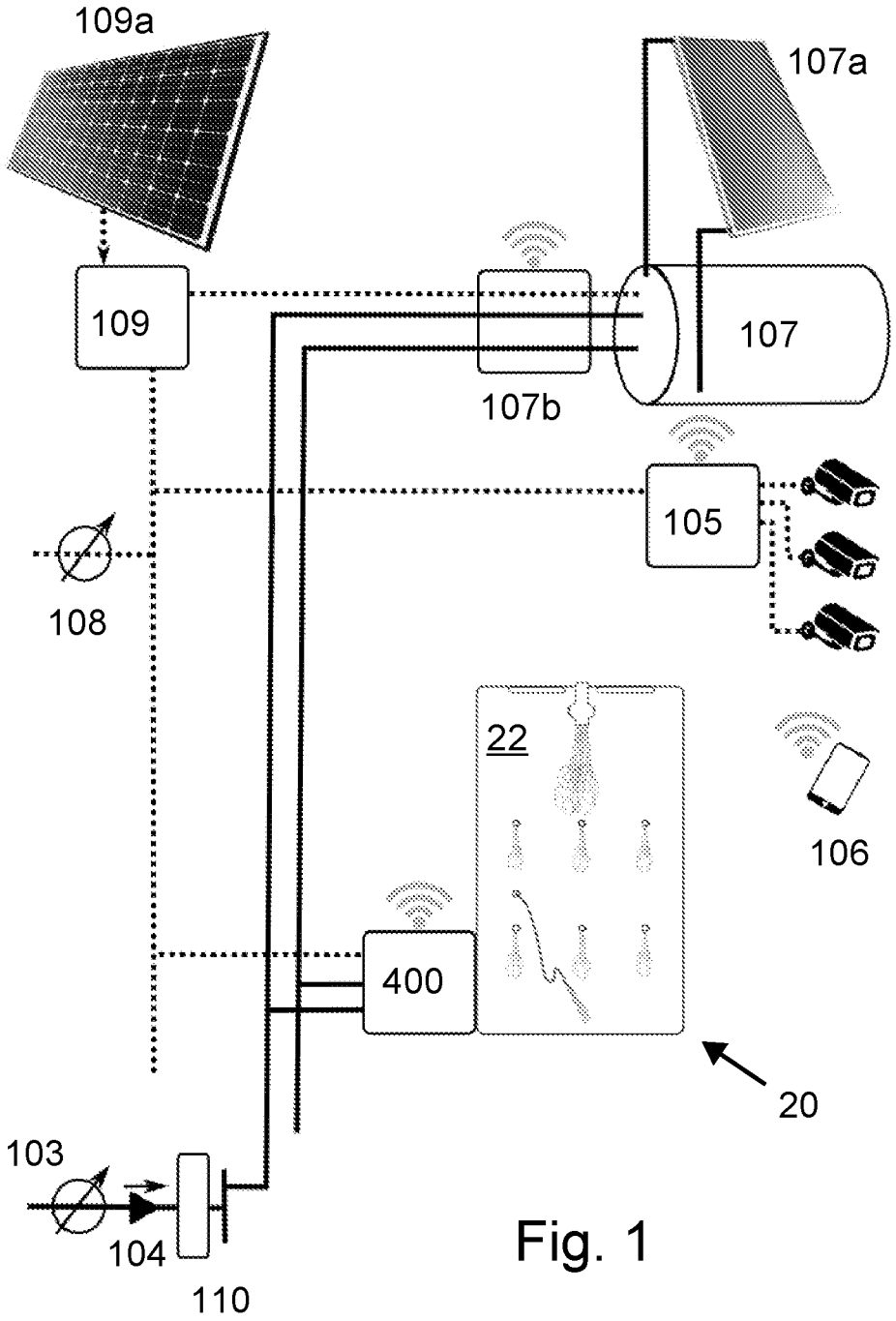
FIG. 1 is a schematic view of a shower system in accordance with embodiments of the present invention, along with optional auxiliary components.
Figure 2:
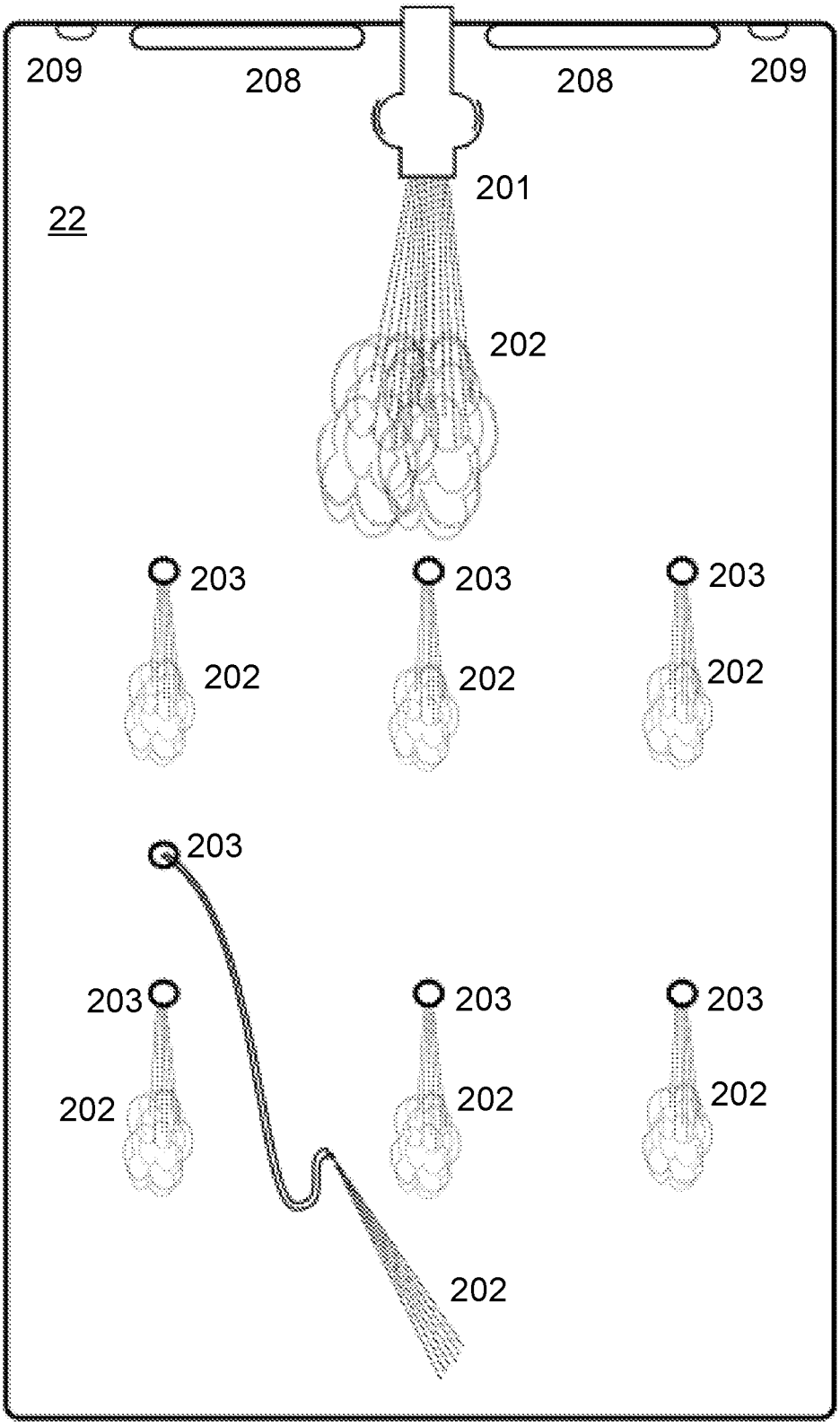
FIG. 2 is a schematic view of further embodiments of the shower system of the present invention, illustrating a main shower head, side nozzles and a low flow water outlet.
Figure 3:
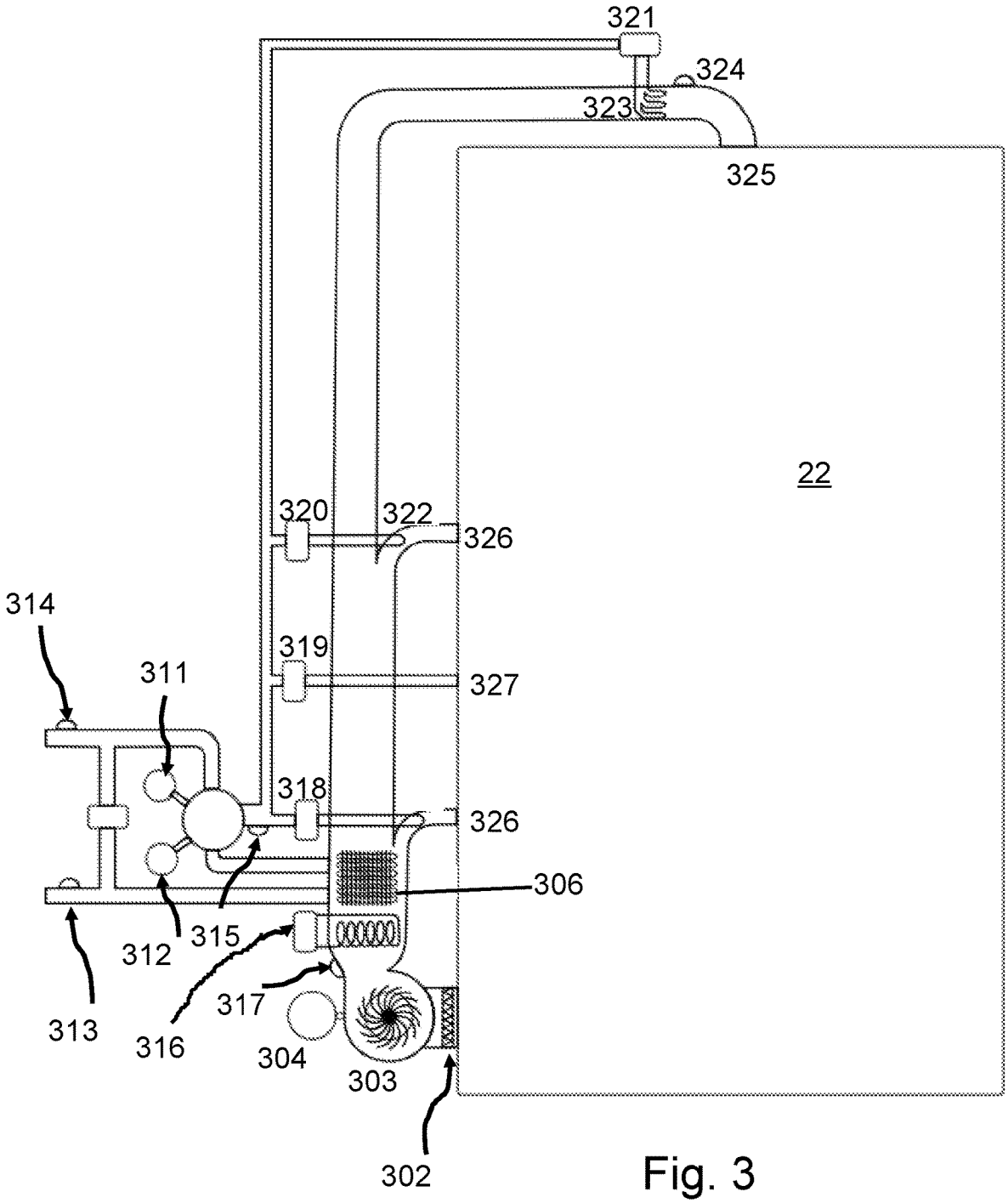
FIG. 3 is a schematic view of exemplary subsystems of the present shower system.

FIGS. 1-3 show an embodiment of a shower system 20 including a shower stall 22 with a plurality of outlet points for dispensing a heated air stream saturated, or significantly saturated, with miniaturized water droplets (hereinafter "spray"). Water is input to shower system 20 via a water input 104 and may include a water flow meter 103 and a water pump 110 for increasing water pressure. Without limitation to particular droplet size, it is noted that the miniaturized water droplets can be on the order of 50-100 micron droplet size.

As seen in FIG. 1, shower system 20 may include peripheral components such as a solar water heating system with a hot water tank 107; a solar water-heating panel 107*a*; and a water circulation system 107*b*, configured to circulate and measure the temperature of hot water. Shower system 20 may interface with a solar powered generation system 109, which includes solar-electric panels 109*a* for generating electricity. Shower system 20 may also interface a security camera system 105 and may be controlled via a smartphone 106. An electrical connection to the peripheral components may include a bi-directional power meter 108.

FIG. 2 shows shower system 20 including a main shower spray head 201 for delivering heated air, saturated or substantially saturated with water, i.e. a spray 202. Shower system 20 may also include a number of side ports or secondary spray outlets 203 also configured to dispense spray 202. Shower system 20 may also include a flexible spray pipe 206. Additionally, shower system 20 may include lights 208, such as an LED color light, whose color and intensity can be controlled from a control panel/screen 400 (described herein-below). Shower system 20 may also include waterproof speakers 209, which can also be configured as microphones, controllable by control screen 400 for music and phone calls.

FIG. 3 shows the main portions of shower system 20, which may be installed behind shower stall 22 or in the ceiling. Shower system 20 includes an air intake 301, which can be located at the bottom of one of the walls of shower stall 22. An air inlet filter 302 can reduce the amount of humidity entering the system. An air supply fan or blower 303 is operable by an air-blower motor 304 at variable speed and is configured to generate a desired air flow. Two heating mechanisms (individually or in combination) can heat the air: an electric air-heating radiator 305 actuated by an operating switch 316 (or via control screen 400); and a heat exchanger or hot water radiator 306, configured to use hot water from the boiler to heat the air. The temperature of the air can be heated to the desired air temperature, controlled by comparing a desired air-water mixture temperature 401 (FIG. 4) and air temperature as measured by a temperature sensor 324.

From a hot water inlet 307, water flows through hot water radiator 306 to a standard mixing valve 310 operated by two motors: a water temperature mix motor 311, which controls the temperature (i.e. mix of hot/cold water) and a water flow motor 312, which controls the water flow. From a cold water inlet 308, water arrives to mixing valve 310 as well. The hot water inlet 307 has a hot water inlet temperature sensor 313 and the cold water inlet 308 has a cold water inlet temperature sensor 314. Sensors 313 and 314 are used to alert the user and stop operation if the hot water inlet is above a given (dangerous) limit, and usable to control water circulation by a circulation valve 309 and the circulation system 107*b*. Temperature sensor 313 provides temperature data to panel display/screen 400 (FIG. 4) for efficiency calculations and system malfunction monitoring. A return air temperature sensor 317 is used by the shower system 20 to determine the quantity of air and water heating required.

The controlled water flows into a plurality of shower-water outlet valves 318, 319, 320, 321, directed to hot water fogger nozzles 322 and 323. For example, a four-port shower is shown including: a main water outlet valve 321; two peripheral shower-water outlet valves 318 and 320; and a low flow water outlet valve 319 for flexible spray pipe 206.

The water is suspended into the heated air stream by a main fogger nozzle 323 and secondary hot water fogger nozzles 322. The main air-water suspension spray outlet 325 can be angle adjustable as can secondary spray outlets 326. The shower system 20 may include a low flow warm water outlet 327 to supply warm water, for example, for intimate washing or shampooing.

Figure 4:
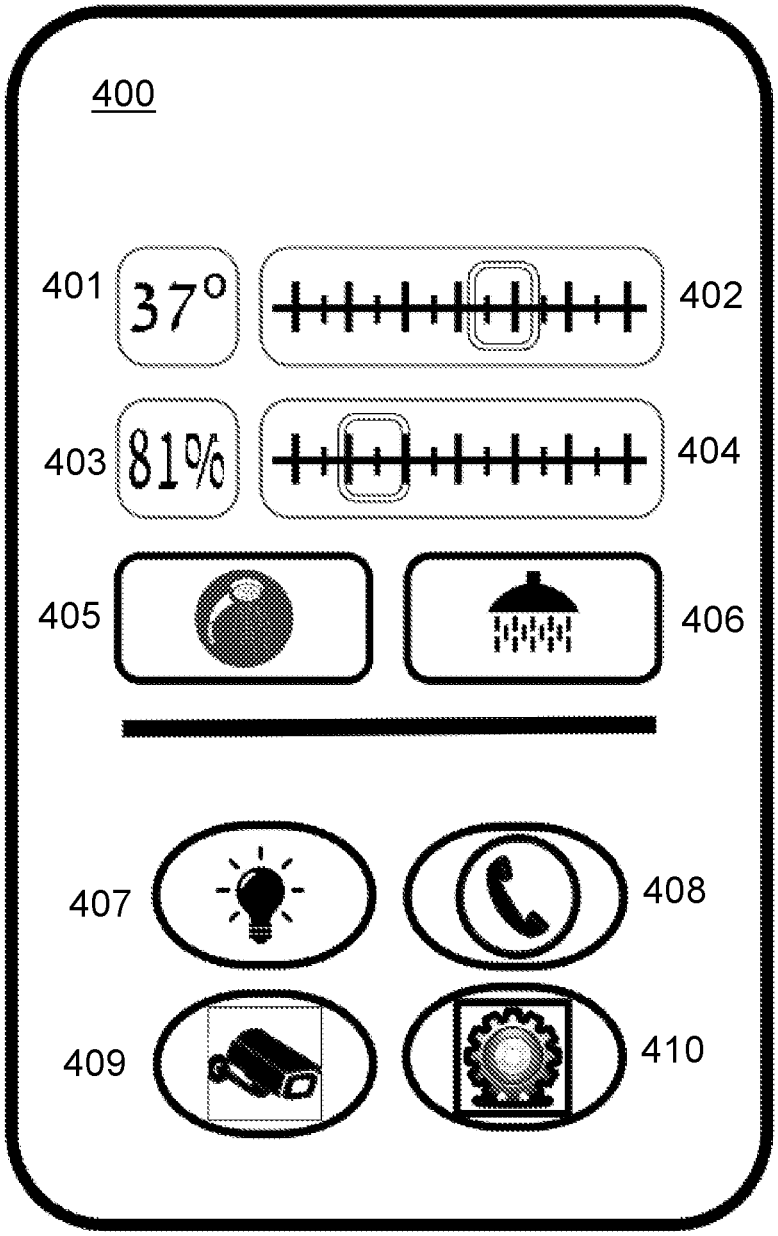
FIG. 4 is a schematic view of a control panel of the shower system in accordance with embodiments of the present invention.

FIG. 4 shows an embodiment where shower system 20 includes a shower control panel/screen 400 that may be used to display the output of security cameras 105 (FIG. 1). The control panel/screen 400 may also be connected to smartphone 106. When entering shower stall 22, the user can select the control panel/screen 400 as a mirror of the user's smartphone and can issue and receive phone calls and other activities as if s/he were using his/her smartphone.

Temperature control is performed in a closed loop by comparing the air-water mixture temperature 401 requested by the user via the operating screen 400 to the temperature obtained by the output of mixing valve 310 measured by mixing valve outlet temperature sensor 315.

Flow control is performed in an open loop by the user's requested hot air-to-water ratio 403 on the operating screen 400, wherein a 100% request opens mixing valve 310 to full open position, and 0% closes the valve completely.

Figure 5:
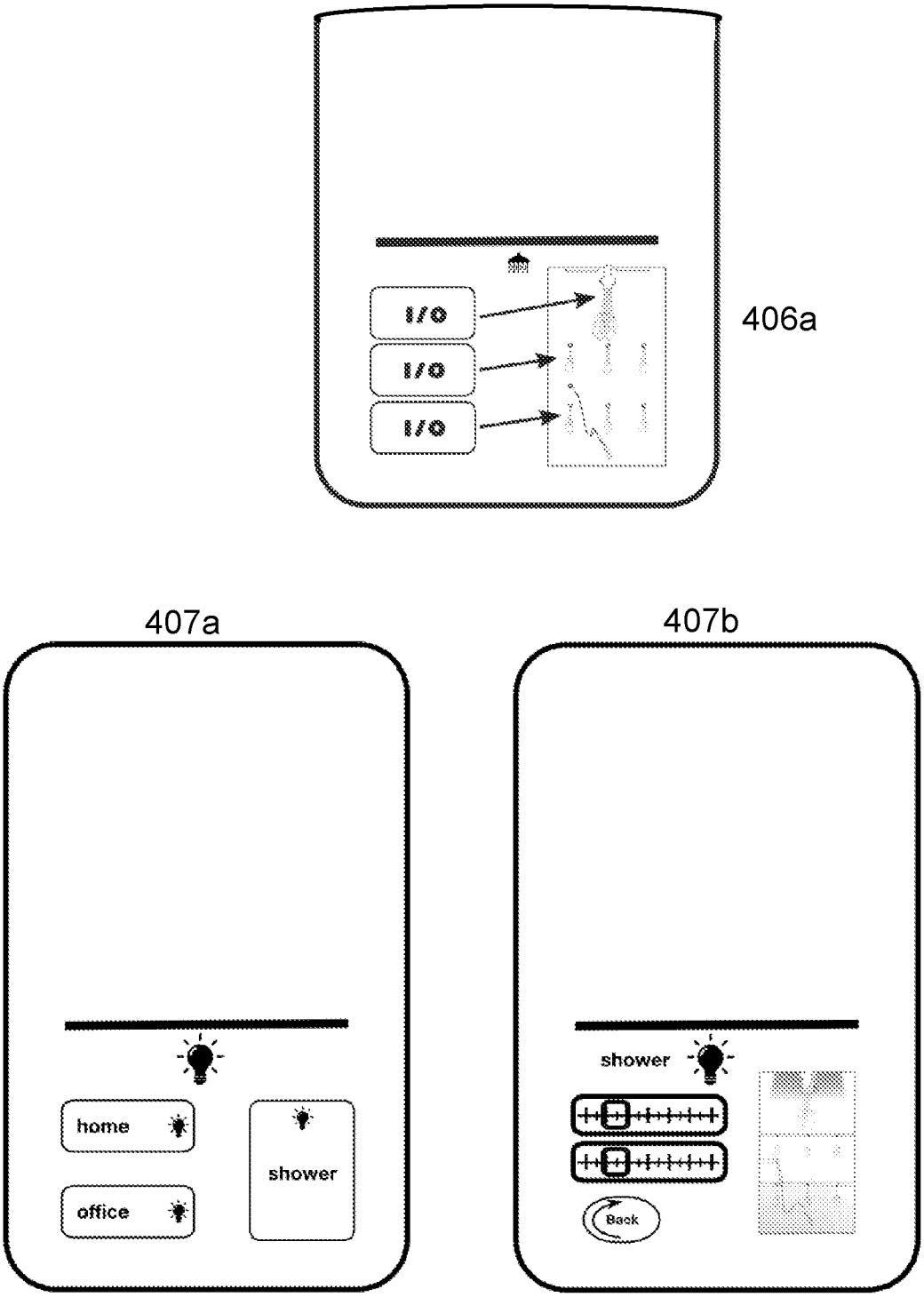
FIG. 5 is a schematic view of exemplary sub-displays of a control panel of the shower system.

The user interface or screen 400 is typically configured to include the following shower controls: the desired air-water mixture temperature 401 controlled by the temperature selector 402, which may be via a linear control mechanism or a rotational mechanism, a digital mechanism or any other suitable design. The hot air-to-water ratio 403 can be controlled by an air-to-water mix ratio selector 404, which can also be a linear, rotational, digital or other mechanism. A mixed hot air-water outlet selector button 406 activates an air-water sub-screen 406*a* (FIG. 5) that includes an operating button that opens and closes the water flow at the main air-water mist outlet 325, which cannot be closed, and in peripheral shower-water outlet valves 318, 320. An activation button 405 can be used to activate and close the low flow water outlets 206, 327 via valve 319.

On the control panel/screen 400, below a line dividing between the main shower functions and the panel's other functions, there are various options, selectable by function or set-up buttons 407, 408, 409, 410. For example: a light control button 407 can open a light control screen 407*a* (FIG. 5) that controls the various lights connected to the shower system 20, including: shower lights 208, which can be controlled by a shower light screen 407*b* (FIG. 5), operated by a shower key on lights screen 407*a*, and home lights, outdoor lights.

Figure 6:
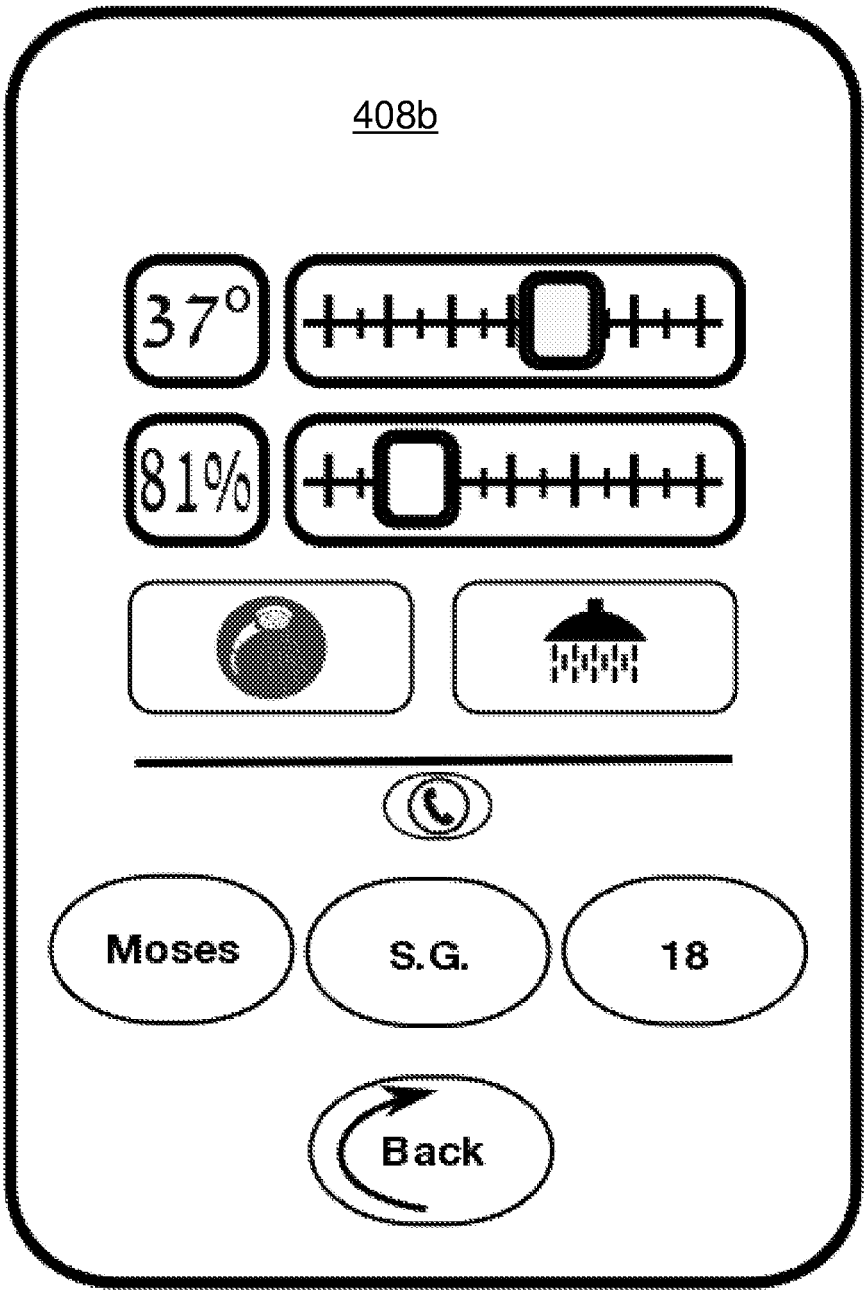
FIG. 6 is a schematic view of a control panel display of the shower system mirroring a smartphone.

Smartphone-function button 408 can be used to switch the panel/screen 400 into a "smartphone mirroring" mode 408*b* (FIG. 6), which is a state wherein the screen shows exactly the smartphone's display and acts as the smartphone. The user can select his name (e.g. Moses, FIG. 6), whereby previous settings for Moses can be used as default or initial settings, and can operate the functions in this mode, for example, to issue and receive phone calls, receive and send text messages, play music and so on, similar to when the smartphone is connected to the car media. Security cameras and related display application can be activated via a security camera button 409. Setup button 410 can be pressed to open one or more screens where other advanced functions can be selected, such as the type of main controls (linear, digital or rotating), and the water saving screen.

Figure 7:
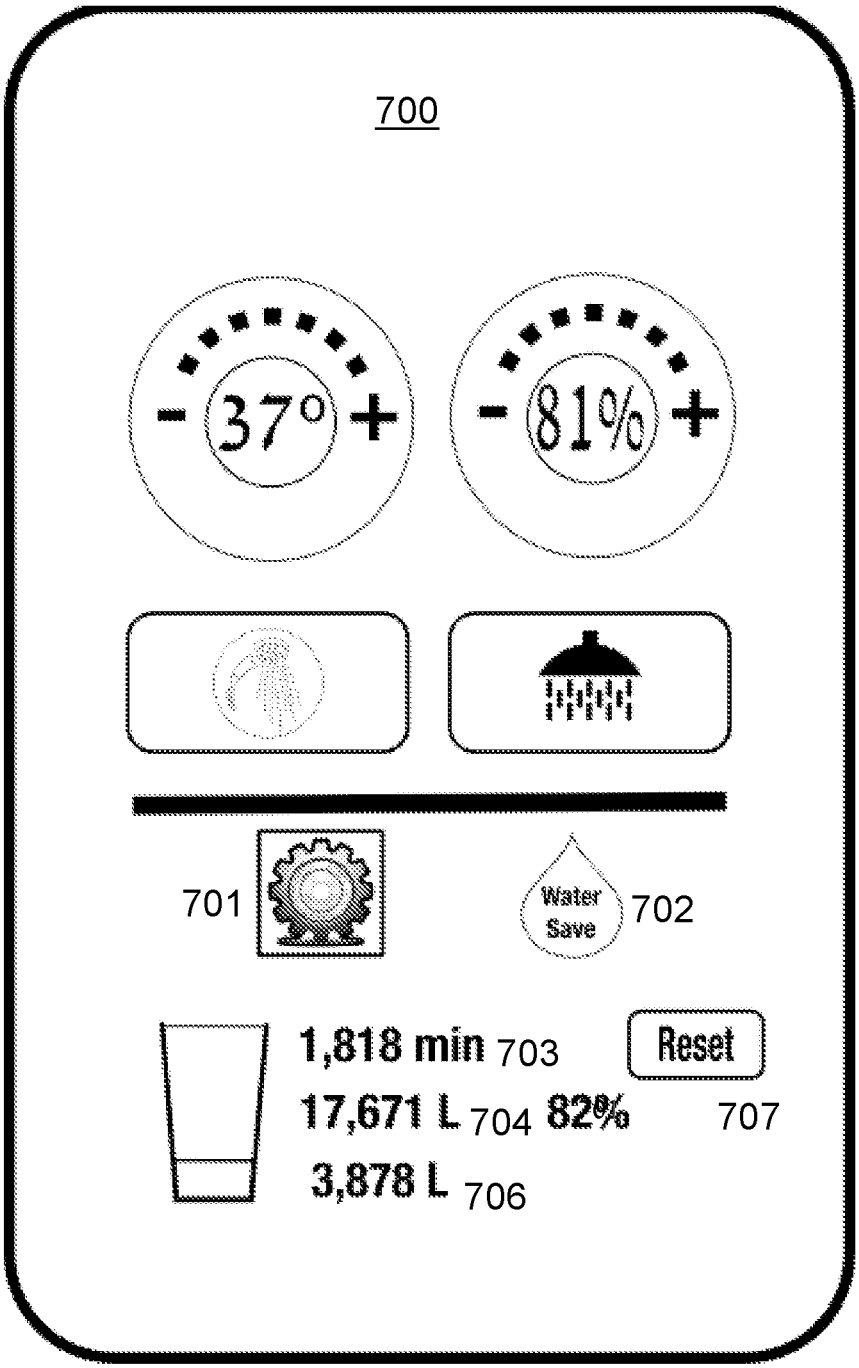
FIG. 7 is a schematic view of a water saving display of the shower system's control panel.

FIG. 7 shows a water saving screen 700 that can be accessed via setup button 410 (FIG. 4), then a "water saving" selection. Screen 700 is the water saving screen, one of the setup options, so "setup" 701 and "water save" 702 icons are shown. Screen 700 also shows shower operation time 703, quantity of water consumed 706; and quantity of water saved in liters 704 and in percent 705, relative to a standard shower. The memory function can be reset via a memory function reset button 707, and then the water savings can be displayed from that point on.

Figure 8:
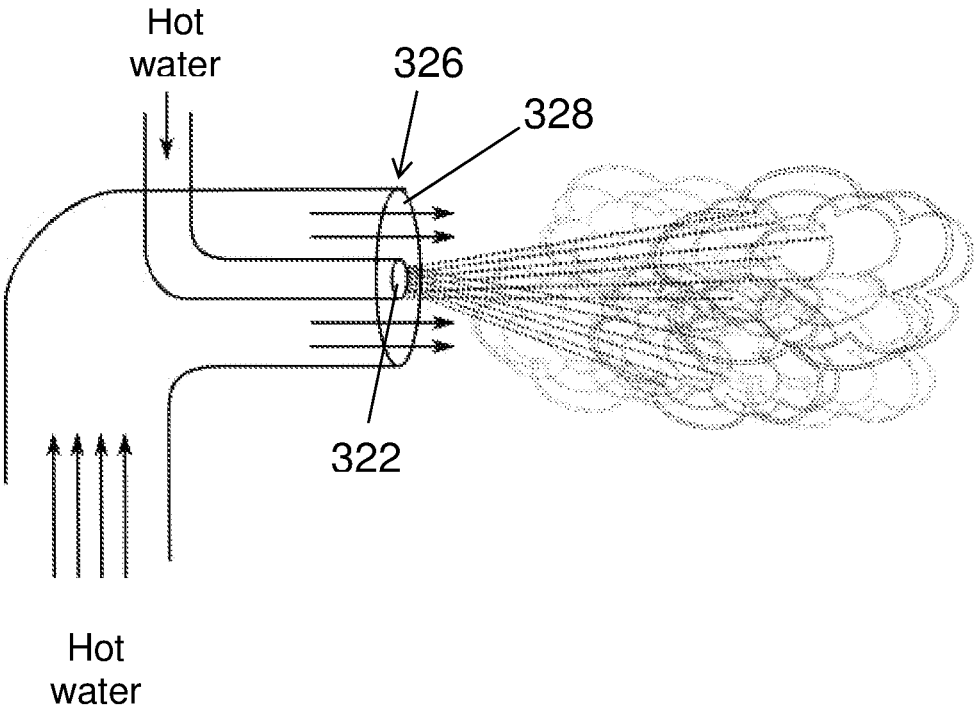
FIG. 8 is a schematic view of a hot-air water suspension spray produced by the shower system in accordance with embodiments thereof.

FIG. 8 illustrates a hot-air water suspension spray produced by the shower system wherein it is seen and noted that the spray is capable of being sprayed outward to a useful distance whereby the spray can appropriately come into contact with the user. Adjacency or near adjacency of the hot water fogger nozzles to respective spray outlets (e.g. hot water fogger nozzle 322 to spray outlet 326 at a hot air outlet 328), i.e. hot water mixes to form a suspension with the hot air at or at least quite close to the point where the hot air is delivered to shower stall 22, contributes to this desired outward/extended spray formation. This desired outward/extended spray condition is in contrast to where the spray diffuses to the point where the spray does not extend outward to provide for efficient contact with the user.

The invention claimed is:

1. A shower system for a shower having a water supply mechanism including a hot water supply and a cold water supply, the system comprising:
- a shower stall;
- an air heating and delivery mechanism for heating and delivering hot air to the shower stall and comprising:
  - at least one air inlet;
  - air piping;
  - an air supply blower to produce an air flow;
  - at least one air heater; and
  - at least one hot air outlet;
- a shower-water piping system for delivering hot and cold water to the shower stall and comprising:
  - a hot and cold water mixing valve; and
  - at least one water fogger nozzle respectively disposed within the at least one hot air outlet to thereby produce a spray of hot air and water suspension; and
  - an air and water temperature and flow controller.

2. The system of claim 1, wherein the at least one air heater includes an electric heater.

3. The system of claim 1, wherein the at least one air heater includes a heat exchanger configured so that the air is heated by hot water from the hot water supply.

4. The system of claim 1, wherein the at least one water fogger nozzle is respectively disposed adjacent the outlet of the at least one hot air outlet.

5. The system of claim 1, further including a water supply pump configured to increase the pressure of the water.

6. The system of claim 1, further including an air inlet filter.

7. The system of claim 1, wherein the air and water temperature and flow controller is configured to be controllable via a controller panel of the shower system.

8. The system of claim 1, wherein the air and water temperature and flow controller is configured to be controllable via a smartphone application.

9. The system of claim 1, wherein the air and water temperature and flow controller is configured to control the ratio of hot air to hot water in the spray.

* * * * *